US012137800B2

(12) United States Patent
Corcoran

(10) Patent No.: US 12,137,800 B2
(45) Date of Patent: Nov. 12, 2024

(54) BOOK STAND

(71) Applicant: Dan E. Corcoran, Ronan, MT (US)

(72) Inventor: Dan E. Corcoran, Ronan, MT (US)

(73) Assignee: Dan E. Corcoran, Ronan, MT (US)

( * ) Notice: Subject to any disclaimer, the term of this patent is extended or adjusted under 35 U.S.C. 154(b) by 0 days.

(21) Appl. No.: 18/155,584

(22) Filed: Jan. 17, 2023

(65) Prior Publication Data

US 2024/0237817 A1 Jul. 18, 2024

(51) Int. Cl.
*A47B 19/00* (2006.01)
*A47B 19/06* (2006.01)

(52) U.S. Cl.
CPC ..... *A47B 19/06* (2013.01); *A47B 2200/0042* (2013.01)

(58) Field of Classification Search
CPC ..... A47B 19/06; A47B 2200/0042; A47B 23/043; A47B 23/044; A47B 97/08; A47B 19/00
USPC .... 248/459, 441.1, 444, 460, 454, 455, 456, 248/465, 442.2, 457
See application file for complete search history.

(56) References Cited

U.S. PATENT DOCUMENTS

| | | | | | |
|---|---|---|---|---|---|
| 958,637 | A * | 6/1910 | Hard | A47B 19/06 | 248/447.2 |
| 3,460,795 | A * | 8/1969 | Dahlin | A47B 23/044 | 248/452 |
| 4,871,139 | A | 8/1989 | Loewke et al. | | |
| 5,067,682 | A * | 11/1991 | Figaro | A47B 23/043 | 248/458 |
| 5,690,310 | A | 11/1997 | Brown | | |
| 7,213,794 | B1 | 5/2007 | Jefferies | | |
| 7,758,009 | B1 | 7/2010 | Chang | | |
| 7,861,995 | B2 * | 1/2011 | Liou | F16M 11/2021 | 248/459 |
| 9,249,922 | B2 * | 2/2016 | Haarburger | A47B 23/042 | |
| 2005/0012016 | A1 | 1/2005 | Teuscher | | |
| 2015/0034781 | A1 * | 2/2015 | Kim | G06F 1/16 | 248/174 |
| 2019/0365092 | A1 * | 12/2019 | Zhang | A47B 23/06 | |

* cited by examiner

*Primary Examiner* — Nkeisha Smith
(74) *Attorney, Agent, or Firm* — Chernoff, Vilhauer, McClung & Stenzel LLP

(57) ABSTRACT

A stand for supporting a book in an inclined reading position having a resting surface, which tilts back such that the book rests at an incline; a shelf surface, which prevents the book pages and book from sliding down and off the resting surface; and a groove between the shelf surface and resting surface, into which the cover of a book may be inserted such that a majority number of the book pages rest on the shelf surface.

10 Claims, 9 Drawing Sheets

BOOK STAND

BACKGROUND

The present invention relates to book stands and methods of using such book stands to eliminate or significantly reduce the likelihood that the reader does not "lose their page".

Readers use book stands to ensure that their book remains at a visible angle without holding the book up or otherwise directly handling the book. For example, cooks and chefs may use the book stand to prop up a recipe book while keeping it open on the page displaying the recipe they are currently cooking. Book stands also clear up surface space by holding large books at upright angles and reducing the amount of space taken up by the book. Musicians also use book stands, also referred to as music stands, for holding sheet music from which they play. Visual artists such as painters may use book stands as small easels.

Book stands of high vertical rests often utilize hold-down clips or arms that the user manually applies to the pages of the book or reading material to ensure the book remains on the stand and breezes, gravity, or other forces do not inadvertently turn the pages of the book. But the clips or arms that stands use must be temporarily removed from the pages of the book when the user wants to turn the pages of the book. Such application, removal, and re-application of the hold-down clips or arms can be an annoyance for cooks who are reading a recipe that spans multiple pages or musicians that must turn pages quickly to avoid falling behind in a musical piece. The hold-down clips or arms are also distracting for readers and otherwise obscures a portion of each of the pages.

What is desired then, is a book stand that holds the book and effectively maintains the desired page of a book open without using hold-down clips or arms.

DETAILED DESCRIPTION OF PREFERRED EMBODIMENTS

Figure 1:
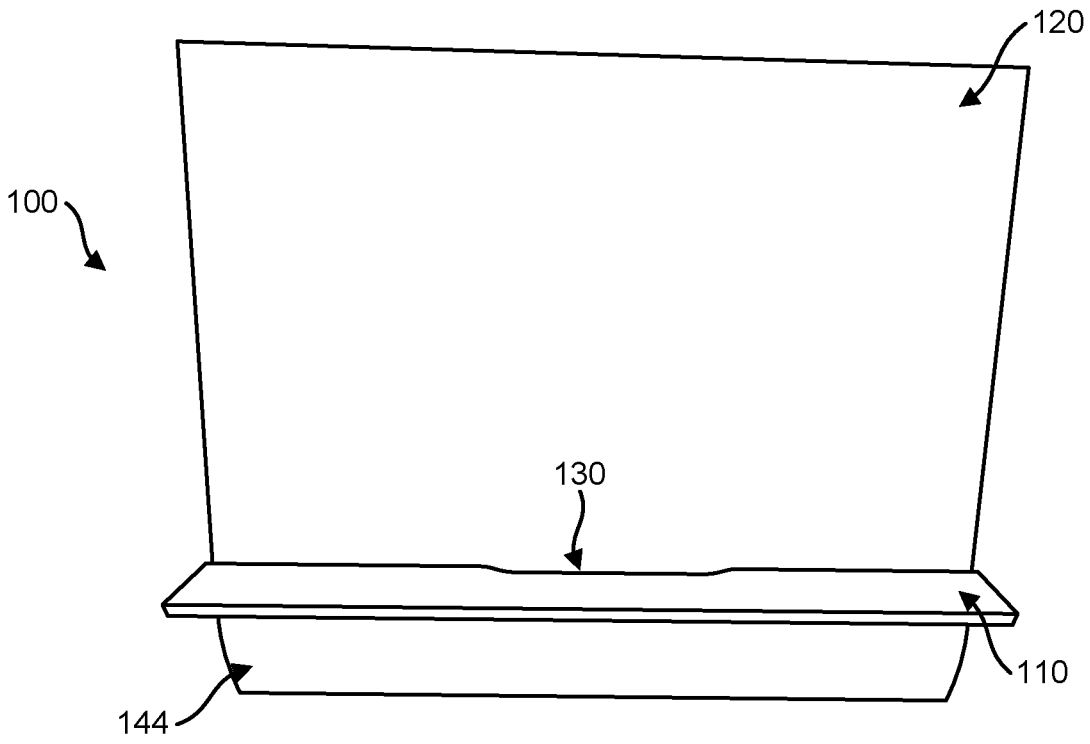
FIG. 1 is a front view of an exemplary book stand, depicting a resting surface and a shelf surface, as well as a groove between the two surfaces.
Figure 2:
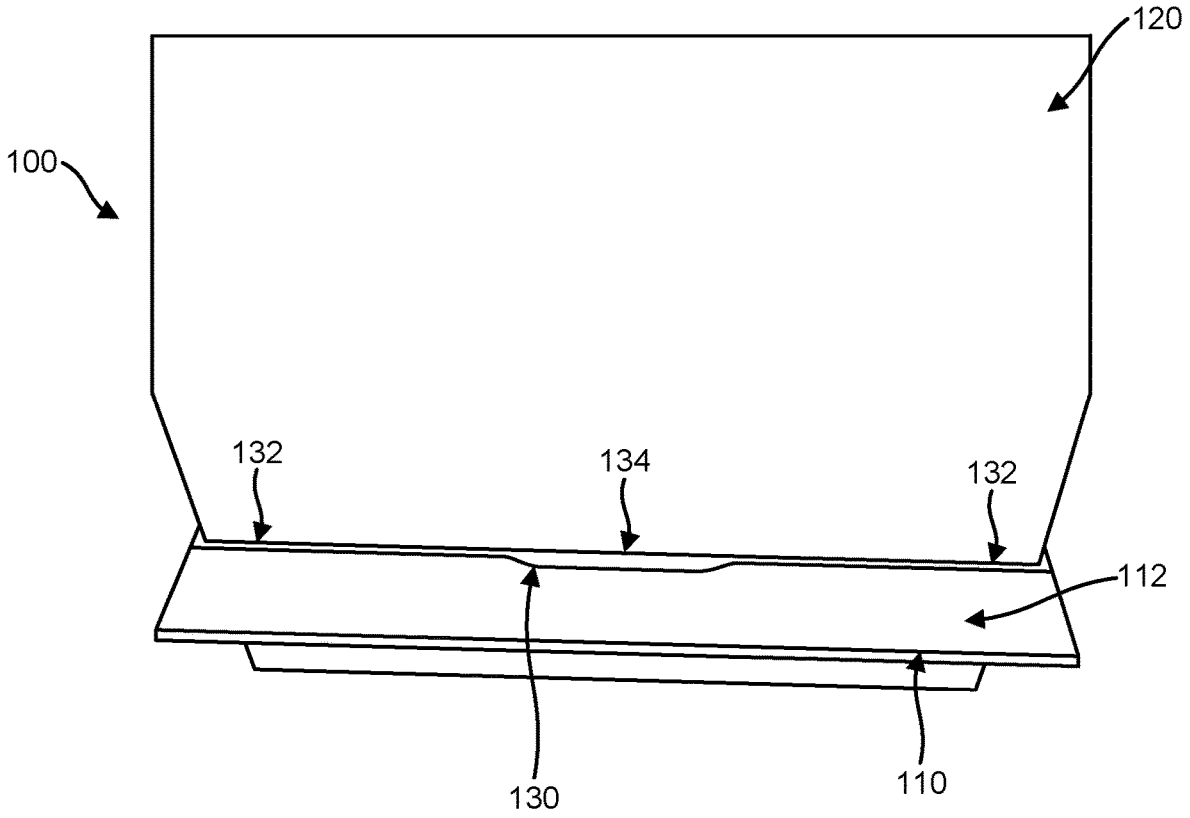
FIG. 2 is a front and raised view of the book stand of FIG. 1.
Figure 3:
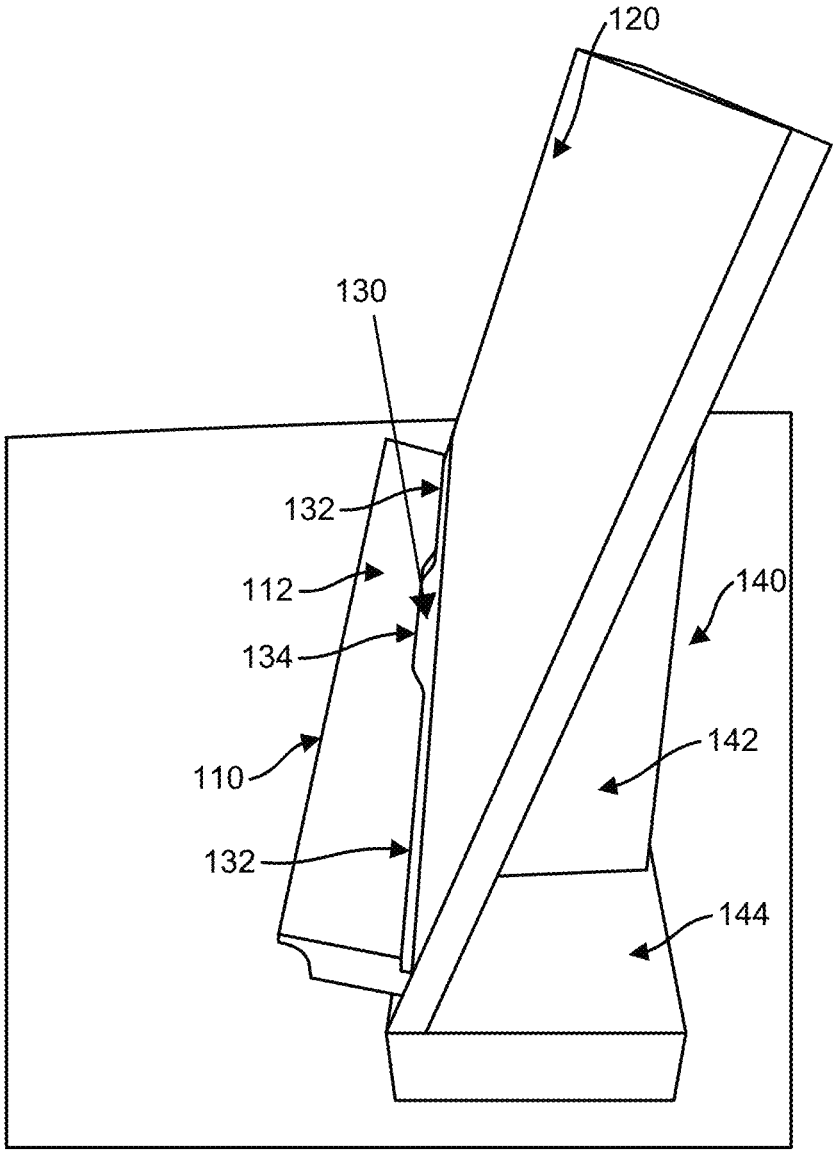
FIG. 3 is a side view of the book stand of FIG. 1.
Figure 4:
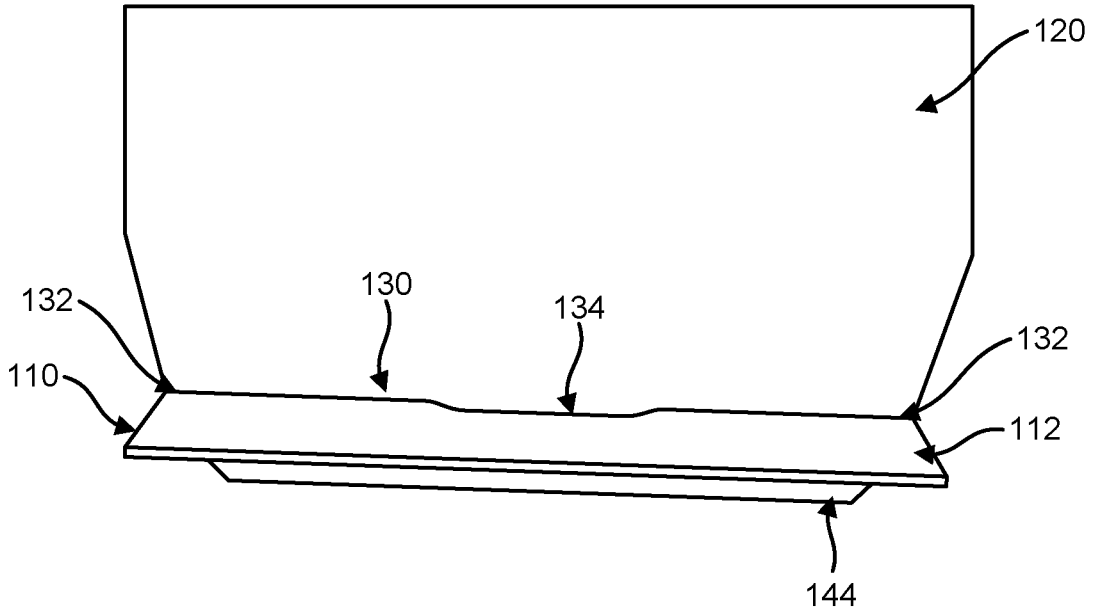
FIG. 4 is a second front and raised view of the book stand of FIG. 1.

Although referred to as a "book stand," this disclosure is not limited to stands for holding books and also includes music stands and any other stand used to maintain reading material, music, pictures, etc. in an upright position, suitable for reference. The term "book stand" is intended to encompass any stand that may be used to maintain such reading material, music, pictures, etc. in an upright position suitable for reference.

Referring to FIGS. 1-5, an illustrative embodiment of a book stand 100 is comprised in part of an inclined rigid rest panel 120, upon which the spine and cover of a book 200 may rest, and a rigid support shelf 110, which inhibits the book pages and/or book from sliding off the inclined rest panel 120. Preferably, the support shelf 110 is arranged at an angle such that when a book rests against the rest panel 120 is it maintained in stationary position. The support shelf 110 is secured to the rest panel 120, or otherwise a unitary construction. The rest panel 120 may be inclined at a variety of upwardly directed angles to ensure that when the book 200 is placed on the rest panel 120, in combination with the support shelf 110, it remains open to the appropriate page and the book 200 remains in a stationary position. The book stand 100 includes a lower portion, of any configuration, to support the rest panel and support shelf on a horizontal lower surface (or otherwise any lower surface).

For example, the rest panel 120 may be inclined anywhere from 45 degrees, upwardly inclined with respect to a level, flat surface on which the book stand 100 rests, to 90 degrees, perpendicular to the flat surface on which the book stand 100 rests. One embodiment of the stand has the rest panel 120 inclined between 50 degrees and 90 degrees. A more preferred embodiment of the stand has the rest panel 120 inclined between 65 degrees and 85 degrees. A more preferred embodiment of the stand has the rest panel 120 inclined between 70 degrees and 85 degrees. A more preferred embodiment of the stand has the rest panel 120 inclined between 75 degrees and 80 degrees. The rest panel 120 may likewise include an adjustment mechanism that permits the user to adjust the inclination the rest panel 120, such that a user may selectively choose how far to incline and secure in the selected inclination of the rest panel 120 with respect to a level, flat surface on which the book stand 100 rests, within any of the ranges set forth herein.

The rest panel 120 of the embodiment of FIGS. 1-5 is preferably 15 inches in width so that it is long enough to support wide books. However, other embodiments may include the rest panel 120 (and support shelf 110) being wider to support even wider books or narrower to reduce the space the book stand 100 takes up. For example, other embodiments may include the rest panel 120 (and support shelf 110) being between 5 inches and 20 inches. Other embodiments may include the rest panel 120 (and support shelf 110) being 7 inches and 18 inches. Other embodiments may include the rest panel 120 (and support shelf 110) being 10 inches and 15 inches. The rest panel 120 (and support shelf 110) may likewise include a width adjustment mechanism that permits the user to adjust the width of the rest panel 120 and/or support shelf 110, such that a user may selectively choose a desired width and secure at the selected width, within any of the ranges set forth herein.

The rest panel 120 of FIGS. 1-5 is preferably eight to ten inches tall, i.e., the distance from the upper surface of the support shelf 110 to the top of the rest panel 120. Other embodiments, however, may include the rest panel 120 being taller to provide additional support for taller books or shorter to reduce the overall size of the book stand 100. For example, other embodiments may include the rest panel 120 being between 4 inches and 15 inches tall. Other embodiments may include the rest panel 120 being between 6 inches and 12 inches tall. Other embodiments may include the rest panel 120 being between 7 inches and 10 inches tall. The rest panel 120 may likewise include a height adjustment mechanism that permits the user to adjust the height of the rest panel 120 such that a user may selectively choose a desired height and secure at the selected height, within any of the ranges set forth herein.

The support shelf 110 of the embodiment of FIGS. 1-5 extends approximately one and a half inches perpendicularly from the rest panel 120. The shelf may be integrated as part of the rest panel, or otherwise a separate part, preferably connected together with an angle brace and fasteners. In other embodiments, the support shelf 110 may extend from below the rest panel 120 and/or may extend from the rest panel 120 at an angle other than perpendicular, preferably within +/−25 degrees of perpendicular, and more preferably within +/−5 degrees of perpendicular. The support shelf 110 may be attached by hinges to the rest panel 120 or another part of the book stand 100 so it can fold up towards the rest panel 120 and reduce the overall size of the book stand 100. The support shelf 110 may likewise be removably attached to the book stand 100. The support shelf 110 may have substantially the same width as the rest panel 120, wider, or narrower, or otherwise have an adjustable width.

Figure 8A:
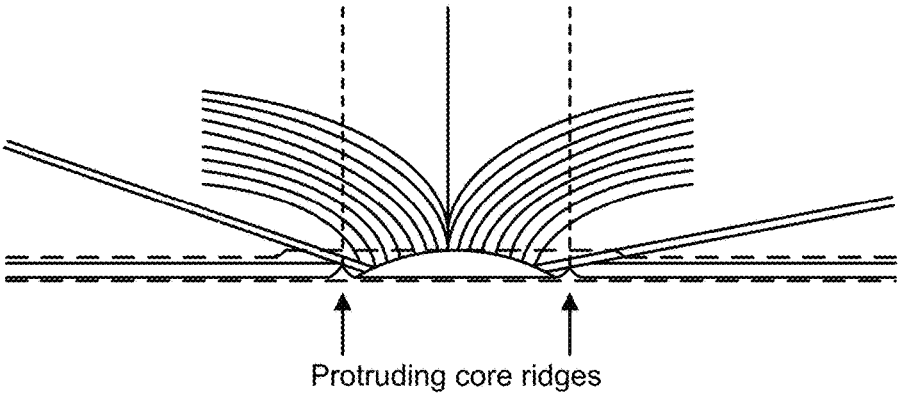
FIG. 8A illustrates a top view of a book resting on the stand.
Figure 8B:
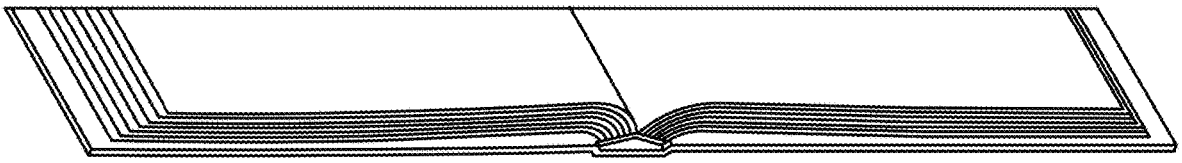
FIG. 8B illustrates a side view of a book laying on a table.

In the preferred embodiment of FIGS. 1-5, a recess 130 is present at the intersection of the upper surface of the support shelf ("support shelf upper surface") 112 and the rest panel 120. The recess 130 of the preferred embodiment is approximately one quarter inch in width (or between $1/8^{th}$ of an inch and $5/16^{th}$ of an inch) at the recess ends 132 and three-quarters of an inch wide (or between $3/8^{th}$ of an inch and 1.5 inches) in a middle portion 134. The recess 130 preferably extends the entire length of the rest panel 120 and support shelf 110. Preferably the recess 130 extends a majority of the length of the support and/or rest panel. Preferably the recess 130 extends 75% or more of the length of the support and/or rest panel. The recess 130 is configured to receive the cover of a book 200 such that the cover extends past the support shelf upper surface 112 when the book 200 rests on the book stand 100, and a larger number of pages of the book rest directly upon the support shelf upper surface 112 as compared to traditional book stand designs which lack such a recess 130. The recess 130 is wider at the middle portion 134 to accommodate the extra width of the spine of the book 200, whereas the recess ends need only accommodate the cover of the book 200. Also referring to FIG. 8A, the width of the middle portion is sized to accommodate the proud "V" shaped ridge formed at the intersection of the book spine and over where the book is opened. A reader could severely damage the spine and cover if the additional space were not provided by the middle portion 134. It is noted that the depth of the recess may be such that the cover of the book rests on the base of the recess, or otherwise the depth may be greater than the cover of the book extending beyond the pages such that the cover terminates in free space. By way of reference, FIG. 8B illustrates a traditional book laying on a flat surface.

By receiving the cover of the book 200 and resting its pages directly upon the support shelf 110, the book stand 100 uses the forces of gravity and friction to inhibit the book 200 from falling off the book stand 100 and inhibits the pages of the book 200 from turning unintentionally. The book stand 100 avoids the hassle of applying and reapplying any clips or arms, which are preferably not included, and the user may change pages with the pages remaining open merely by turning the page. The pages most proximate the reader (i.e., the foremost pages) are the primary pages that are anchored by gravity and friction to the shelf to inhibit the pages of the book 200 from turning unintentionally. In general, the pages more proximate the reader tend to be increasingly more anchored by gravity and friction to the shelf to inhibit the pages of the book 200 from turning unintentionally. Also, the forward upright edge of the recess prevents the tendency of the cover of the upright book from inadvertently closing.

Other embodiments may include the recess 130 extending less than the full width of the rest panel 120, or the book stand 100 may have multiple recesses. Still other embodiments may include the support shelf 110 including multiple support shelf upper surfaces 112 for the book 200 to rest upon and each support shelf 110 having its own recess 130. The recess ends 132 may be thinner or wider than one quarter inch, and the middle portion 134 may likewise be thinner or wider than three quarter inches. The entire recess 130 may be the same width, designed so that the spine of the book 200 may be placed at any point along the recess 130. Other variations may include multiple recesses 130 of varying widths to accommodate different books or so that the incline of the book 200 may be changed merely by selecting which recess 130 the cover of the book should be inserted into.

The book stand 100 of FIGS. 1-5 includes a solid base 140 to ensure the rest panel 120 remains at the correct angle of incline and holds the book stand 100 up to eye level. The base 140 of FIGS. 1-5 may include a pillar 142 and a foot member 144. Other bases may be used for other embodiments of the book stand 100. The base 140 may be one piece formed together or made up of multiple pieces, so long as it is suitable to keep the rest panel 120 and support shelf 110 inclined at the desired angle.

Figure 5A:
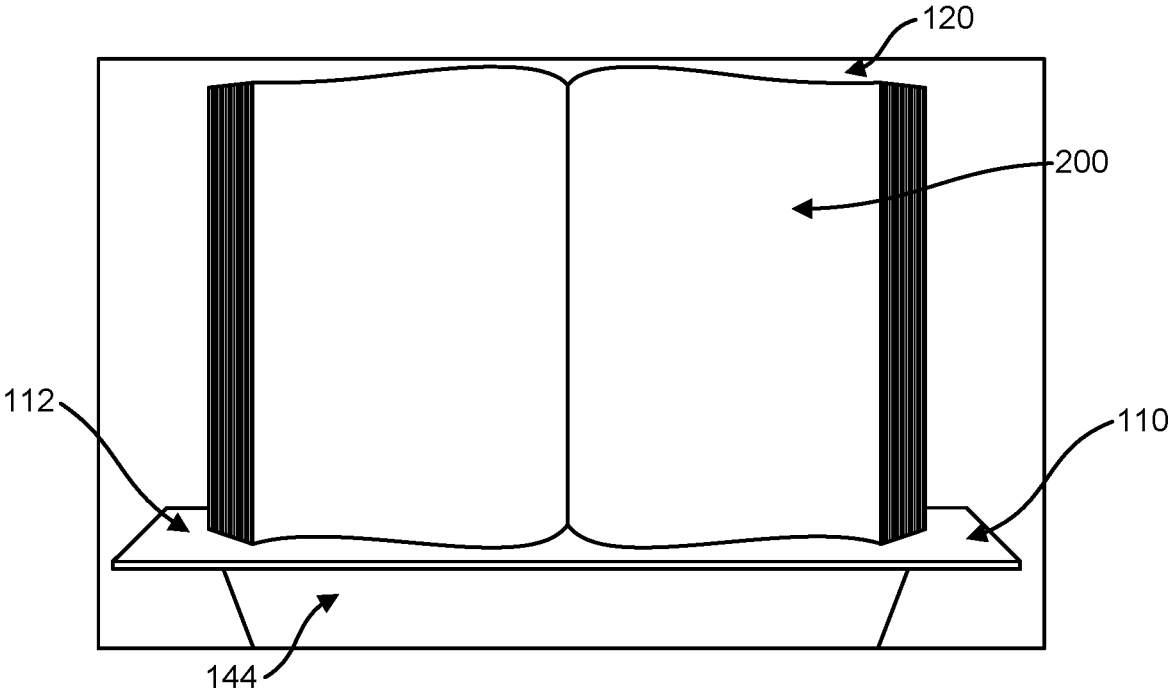
FIGS. 5A-5C is a view of the book stand of FIG. 1, with an open book supported by the stand, and surface details.
Figure 5B:
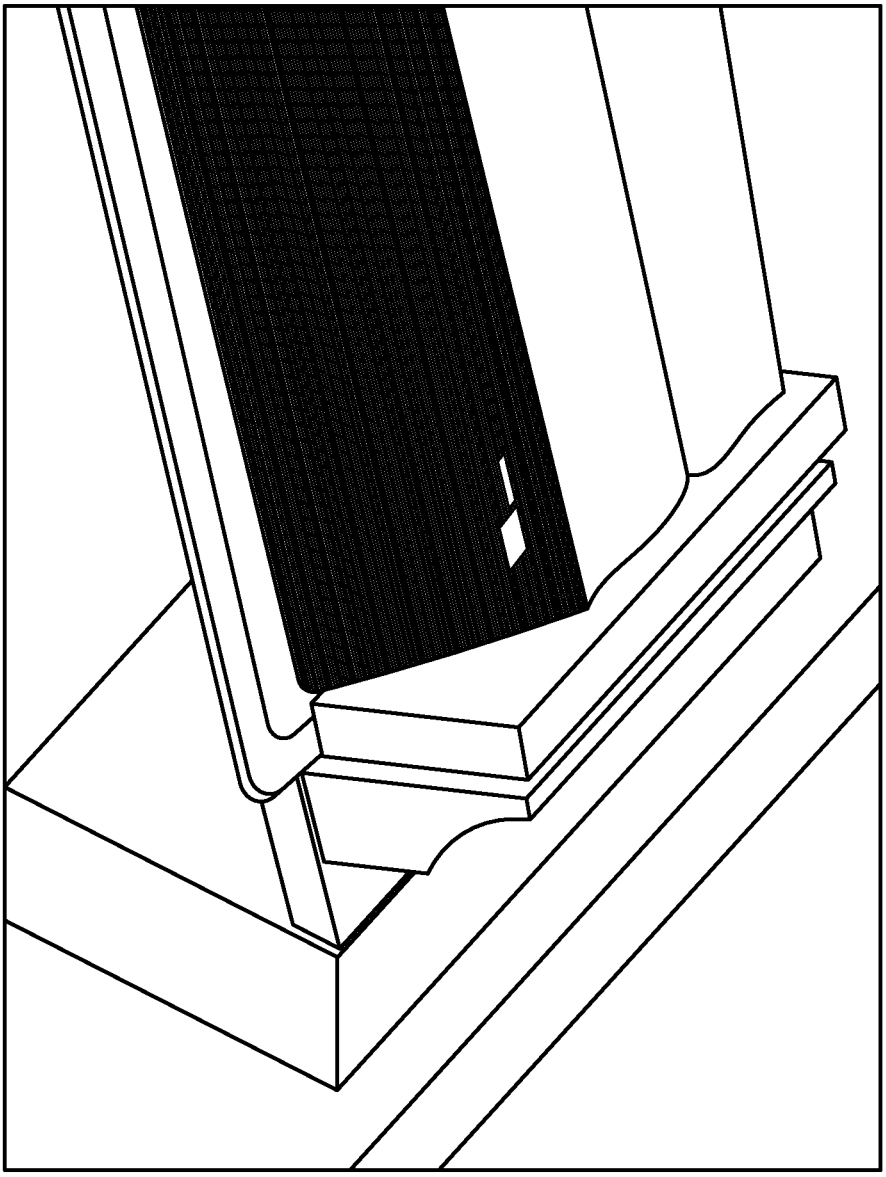
Figure 5C:
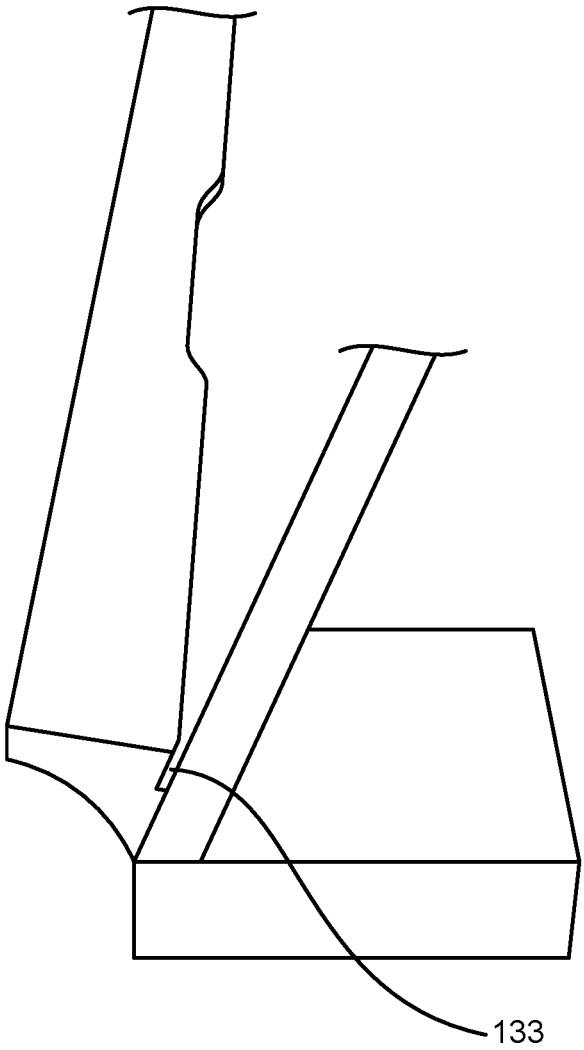

Referring to FIG. 5C, when an open book is applied or mounted on the book stand the open book is preferably affected by four surfaces. One of the surfaces is the upright support for the book's back cover 120. Another of the surfaces is the resting surfaces for the individual pages of the shelf 110. A further one of the surfaces is the inside surface 133 on the side of the recess. Yet another one of the surfaces is the cover resting surface 130. The inside surface 133 facilitates and/or restricts the tendency of the book's cover to come forward and close, where the cover itself tends to exert the greatest force with respect to the book's tendency to close. Without the inside surface, the unrestricted force generated from the cover's propensity to close would act upon the individual pages and result in the pages being drive forward in a chain reaction. With the inside surface 133 restricting the cover together with the individual pages being restricted by friction and gravity produce a combined desired effect of maintaining the book open.

Figure 6:
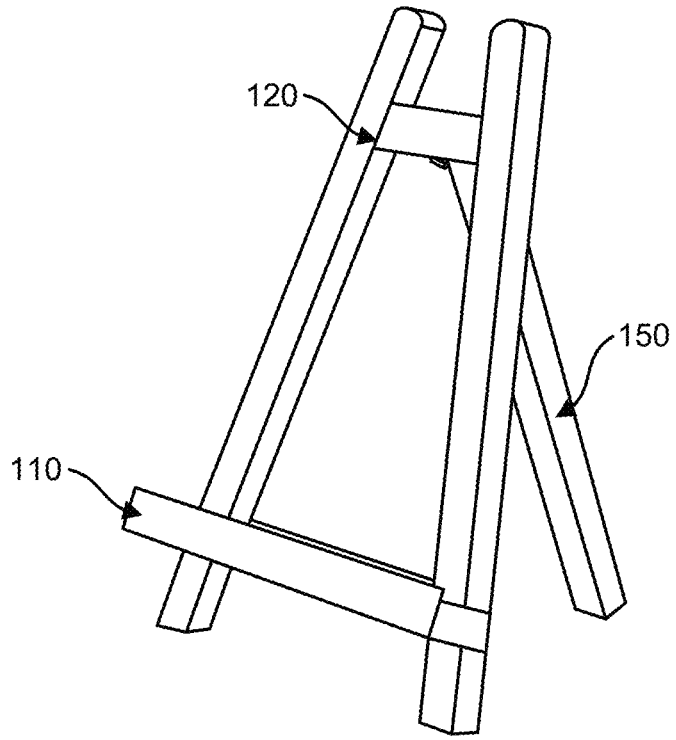
FIG. 6 is a side view of a book stand with an A-frame base illustrating modified base designs.

For example, referring to FIG. 6, the base 140 may be an A-frame in which the top of the rest panel 120 is connected by hinges to a base comprised of one or more leg members 150. By operation of the hinges, the leg member(s) 150 may be moved away from the bottom of the rest panel 120 so the leg member 150 and rest panel 120 both provide support for the book stand 100.

Figure 7:
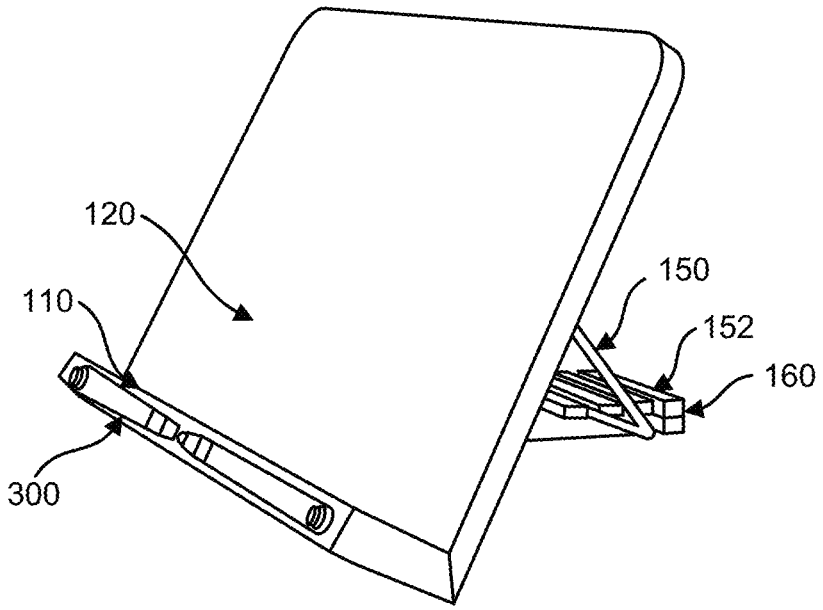
FIG. 7 is a side view of another book stand with an arm-and-slot mechanism for its base illustrating modified base designs.

Another example, illustrated in FIG. 7, has the base 140 including a leg member 150 and an arm member 160, both connected by hinge to the rear surface of the rest panel 120, opposite the side of the surface on which the book 200 rests. The arm member 160 folds down at the hinge so that it rests on the surface the book stand 100 rests upon. The arm member 160 may be placed in one of several slots 152 in the leg member to adjust the incline of the rest panel 120. FIG. 7 also depicts a set of hold down clips or arms 300 that traditional book stands utilize, and this disclosure seeks to remedy.

Figure 9:
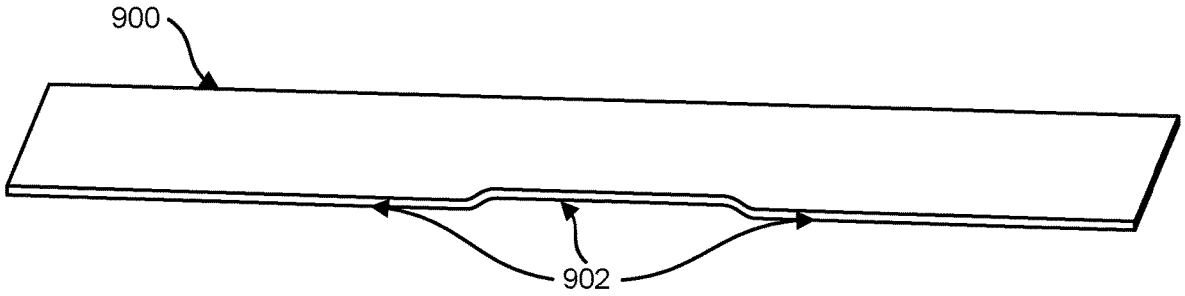
FIG. 9 illustrates an enhanced add-on shelf for a book stand.

Referring to FIG. 9, in another embodiment an add-on shelf 900 may be a structure that includes a recess 902 formed on a portion of the rearward portion of the add-on shelf 900. The recess 902 has a relatively narrow profile toward the outer portions and a relatively wide profile toward the narrow profile, in a manner as shown in FIG. 1. The add-on shelf 900 may be supported by a shelf of a traditional book stand, or otherwise secured to the shelf of a traditional book stand (e.g., Velcro, screw, clasp), to provide improved book support. In this manner, a traditional book stand may be modified to include the benefits of the enhanced book stand.

It will be appreciated that the invention is not restricted to the particular embodiments that have been described, and that variations may be made therein without departing from the scope of the invention as defined in the appending claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A stand for supporting an object having a page and a binding comprising:

(a) a rigid panel suitable for supporting a cover of said object having a page and a binding;

(b) a rigid support arranged at an angular orientation with respect to said rigid panel;

(c) a lower portion suitable to support said rigid panel and said rigid support on a horizontal lower surface;

(d) the intersection of said rigid panel and said rigid support defining a recess along the length of said rigid support;

(e) the recess having a width greater in a central portion of said rigid support than a width greater along a majority of a non-central portion of said rigid support is configured such that said binding is received within the recess and a majority of an end of said page is supported by resting on said rigid support.

2. The stand of claim 1 wherein said rigid panel is inclined rearwardly when said stand is supported by a horizontal surface.

3. The stand of claim 1 wherein said lower portion is attached to said rigid support in a fixed angular orientation.

4. The stand of claim 1 wherein said rigid panel is oriented at an angle of between an angle of 45 degrees and 90 degrees with respect to a lower horizontal surface.

5. The stand of claim 1 wherein said rigid panel is oriented at an angle of between an angle of 65 degrees and 85 degrees with respect to a lower horizontal surface.

6. The stand of claim 1 wherein said rigid panel has a width between 5 and 20 inches.

7. The stand of claim 1 wherein said rigid panel has a height between 4 and 15 inches.

8. The stand of claim 1 wherein said rigid support extends at an angle between-25 degree and +25 degree with respect to perpendicular to said rigid panel.

9. The stand of claim 1 wherein said recess proximate said rigid support along said majority of the length of said rigid support has a width between ⅛th of an inch and 5⁄16th of an inch.

10. The stand of claim 1 wherein said recess proximate said central portion said rigid support has a width between ⅜th of an inch and 1.5 inches.

* * * * *